US006032679A

United States Patent [19]

McGlauflin

[11] Patent Number: 6,032,679

[45] Date of Patent: Mar. 7, 2000

[54] CIGAR PUNCHING DEVICE

[76] Inventor: Michael McGlauflin, 12570 Post Creek Pl., Germantown, Md. 20874

[21] Appl. No.: 09/070,241

[22] Filed: May 1, 1998

[51] Int. Cl.[7] ..... A24F 13/24

[52] U.S. Cl. ..... 131/255; 131/253

[58] Field of Search ..... 131/248, 253, 131/255, 254

[56] References Cited

U.S. PATENT DOCUMENTS

| | | | |
|---|---|---|---|
| 297,956 | 4/1884 | Ungerer . | |
| 807,202 | 12/1905 | Pintz . | |
| 925,158 | 6/1909 | Cragg . | |
| 1,734,620 | 11/1929 | Giacopini . | |
| 2,832,354 | 4/1958 | Miller . | |
| 5,535,763 | 7/1996 | Conte . | |
| 5,765,569 | 6/1998 | Kemanjian | 131/248 |
| 5,862,808 | 1/1999 | Albarello | 131/255 |

*Primary Examiner*—Stanley S. Silverman
*Assistant Examiner*—Jacqueline A. Ruller
*Attorney, Agent, or Firm*—Liniak, Berenato, Longacre & White

[57] ABSTRACT

A cigar punching device is provided. A cigar punching device includes a cap with a first closed end and a second end. The second end includes an opening. The device further includes a ram having a head portion and an externally threaded shank portion whereby a distal end of the shank portion is secured within the opening of the second end of the cap. A cutting member includes a central bore and is disposed about the ram. The cutting member includes an internally threaded proximal end portion, an intermediate portion, and a tubular cutting distal end portion. The internal threads of the cutting member match and mate with the external threads of the ram so that the cutting member may be screwed about the ram between a first position wherein the proximal end of the cutting member abuts the second end the cap and the head portion is penetrated through the cutting end portion, to a second position wherein the proximal end of the cutting member is spaced from the second end of the cap, the head portion is retracted within the cutting member, and the cutting end portion is exposed and operative to receive and thereby sever a tip of a cigar.

29 Claims, 4 Drawing Sheets

CIGAR PUNCHING DEVICE

BACKGROUND OF THE INVENTION

The present invention relates to a cigar punching device. More particularly, the present invention relates to an improved cigar punching device which is small, lightweight, and infinitely adjustable.

Smoking cigars has become a popular activity among many individuals. Recently, there has been an amazing trend of cigar smoking exemplified by the numerous cigar shops and cigar lounges established nationwide. In order to smoke a cigar, the tip of the cigar should be pierced, to allow smoke to be drawn into the mouth of the individual when smoking. In the past, a needle has often been used to pierce cigars. However, needles have a tendency to close the pores of the cigar, thereby preventing the smoke from being drawn into the mouth of the smoker.

Alternatively, a number of cigar punching devices have been used, which cut the tip of the cigar so that smoke may be drawn into the mouth of the individual more easily than when pierced with a needle. Typically, a cigar punching device includes a continuous tubular edge portion which is inserted into a tip of the cigar and twisted to sever and extract the cigar tip.

For example, U.S. Pat. No. 297,956 to Ungerer disclose, a cigar piercing device including an outer tubular case with a center bar secured within the case. A sliding tubular cutter is disposed between the central bar and the outer case, and telescopes between a first exposed position outside the outer case to a second inoperative position inside the outer case. By projecting the tubular cutter forward to its exposed position and thrusting the cutter into the cigar, a tip of the cigar is extracted by the cutter and becomes lodged therein. When the cutter is withdrawn back into the case over the bar, the bar clears the cutter of the tobacco. This particular device has a disadvantage in that it does not allow the piercing device to be set at various cutting lengths. In addition, this device lacks any means to maintain the cutter in the operative position as it is being forced into the end of a cigar. Thus, adequate pressure cannot be maintained in order to punch the tip of a cigar, because the device is forced back to its inoperative and withdrawn position. Finally, the cutter does not contain any type of safety mechanism preventing accidental exposure thereof, which may result in inadvertent injury.

Several other solutions have been directed towards incorporating a spring in cooperation with the outer case and the inner cutter, which functions to urge the cutter to its inoperative position within the outer case. U.S. Pat. No. 1,734,620 to Giacopini discloses a cigar piercer with two telescoping tubular members. A cutter is secured to the inner telescoping case so that, when the inner case telescopes within the outer case, the cutter is exposed for operation. Once the cutter penetrates the tip of the cigar, releasing pressure from the end of the inner case causes the spring to expand back to its normal position, thereby retracting the cutter within the outer case.

U.S. Pat. No. 807,202 to Pintz disclose a similar structure to that disclosed by Giacopini, with an inner and outer telescoping case, whereby a cutter is secured to the inner case, and a spring is positioned between the inner and outer case for returning the cutter to its normally inoperative position. While these devices offer an advantage in that the cutter cannot be as easily exposed, they may still accidentally expose the cutter by pressure on the inner case, thereby potentially causing inadvertent injury to the user or others.

In addition, these devices are further complicated by the need for a core ejector, which must be positioned in the middle of the device to clear the tip of the cigar from the cutter.

Moreover, the above-mentioned cigar punching devices, which require the use of a spring to return the cutter to its initial position, have a disadvantage in that tobacco may become wedged between the outer and inner telescoping tubes, thereby greatly reducing the sliding ability of the cutter. In addition, the tobacco could also become lodged within the spring, thereby reducing the efficiency of the spring.

Another example of a cigar cutter is disclosed in U.S. Pat. No. 925,158 to Cragg. Cragg discloses a cigar cutter and perforator which includes an outer case having the cutting portion on the surface of the outer case. Thus, in order to sever the tip of the cigar, the cigar is inserted perpendicular to the device and then twisted. The cutting surface, because it is on the outer surface of the case, is always exposed, which increases the chances of injury. In addition, when using the device to sever the tip of the cigar, stabilizing the cigar in the cutter becomes more difficult because of the awkward positioning of the cigar with respect to the device.

Other attempts have been made to design a cigar punching device which is simple in structure, yet safe to use. Cigar punching devices have been as simple as constructing an outer case with a continuous cutting edge, which is shielded by a detachable cap. However, because the cap is detachable, it may become lost, thereby permanently exposing the cutting edge. In addition, extracting the tobacco lodged in the cutter becomes extremely difficult.

U.S. Pat. No. 5,535,763 to Conte discloses a cigar punch and tobacco ejector. Similar to the prior art disclosed above, this cigar punching device is formed of two separate members, one member including a cutter, and the other member for housing the cutter when it is not in use. Associated with the cutter is a plunger assembly adapted to travel within the cutter, to remove a severed cigar tip from the cutter. Consequently, because the two members may be separated, the housing or storage member may become lost, resulting in a permanently exposed cutter. In addition, the structure of the disclosed cigar punch is rather complicated, resulting in a high cost to manufacture the product. Conte discloses the requirement of a separate plunger to remove the severed tip from the cutter, further complicating the device.

It is therefore apparent that a need exists in the art for an improved cigar punching device, that overcomes these disadvantages.

SUMMARY OF THE INVENTION

It is therefore an object of the present invention to provide an improved cigar punching device that overcomes the drawbacks presented by the prior art designs.

It is another object of the present invention to provide a cigar punching device which is not readily detachable into two pieces.

It is a further object of the present invention to provide a cigar punching device which is small and lightweight, and may be carried on a key chain.

It is still a further object of the present invention to provide a cigar punching device which is infinitely adjustable, but precise in the adjustment.

It is yet another object of the present invention to provide a cigar punching device which is simple in construction and easy to manufacture.

It is still a further object of the present invention to provide a cigar punching device which avoids clogging of the cutter by the severed cigar tip.

Still another object of the present invention is to provide a cigar punching device whose cutter may always be returned to an inoperative, non-cutting position.

These and other objects of the present invention, which will become more apparent upon review of the detailed description to follow, are satisfied by a cigar punching device having a cap with a first closed end and a second end. The second end includes an opening. The device further includes a ram having a head portion and an externally threaded shank portion whereby a distal end of the shank portion is secured within the opening of the second end of the cap. A cutting member includes a central bore and is disposed about the ram. The cutting member includes an internally threaded proximal end portion, an intermediate portion, and a tubular cutting distal end portion. The internal threads of the cutting member match and mate with the external threads of the ram so that the cutting member may be screwed about the ram between a first position wherein the proximal end of the cutting member abuts the second end of the cap and the head portion is penetrated through the cutting end portion, to a second position wherein the proximal end of the cutting member is spaced from the second end of the cap, the head portion is retracted within the cutting member, and the cutting end portion is exposed and operative to receive and thereby sever a tip of a cigar.

A cigar punching device includes a ram having a head portion and an externally threaded shank portion. A cutting member includes a central bore and is disposed about the ram. The cutting member includes an externally threaded proximal end portion, an intermediate portion, and a tubular cutting distal end portion. The internal threads of the cutting member match and mate with the external threads of the ram so that the cutting member may be screwed about the ram between a first position wherein the head portion of the ram is penetrated through the cutting end portion and a second position wherein the head portion is retracted within the cutting member and the cutting end portion is exposed and operative to receive and thereby sever a tip of a cigar.

A cigar punching device includes a first member having an internally threaded central bore. The device also includes a ram having a head portion and an externally threaded shank portion. The external threads of the shank portion match and mate with the internal threads of the first member. A cutting member is disposed about the ram and includes a central bore. The cutting member also includes a proximal end portion, an intermediate portion and a tubular cutting distal end portion, wherein an internal diameter of the intermediate portion is greater than an internal diameter of the proximal end portion, forming an internal annular surface therebetween. A spring is disposed about the ram in said intermediate portion of the cutting member between the internal annular surface of the cutting member and the head potion of the ram whereby screwing the first member towards the cutting member causes the spring to be compressed between the head portion and the internal annular portion, the head portion to be retracted within the cutting member, and the cutting end portion to be exposed and operative to receive a tip of a cigar.

BRIEF DESCRIPTION OF THE DRAWINGS

The invention will be described further in connection with the attached drawings, wherein like reference numbers refer to corresponding parts throughout the several views of preferred embodiments of the invention and wherein.

DETAILED DESCRIPTION OF THE INVENTION

The cigar punching device of the present invention is designed to provide an integral device which is not separable into two pieces, which is positively retained without locks or safety mechanisms. The present device is simple in construction, with a minimal number of components, which is both lightweight and durable.

The following description is meant to be exemplary of certain preferred embodiments of the present invention. It should be understood that many other embodiments and variations thereof are also contemplated in the spirit and scope of the present invention.

Figure 1:
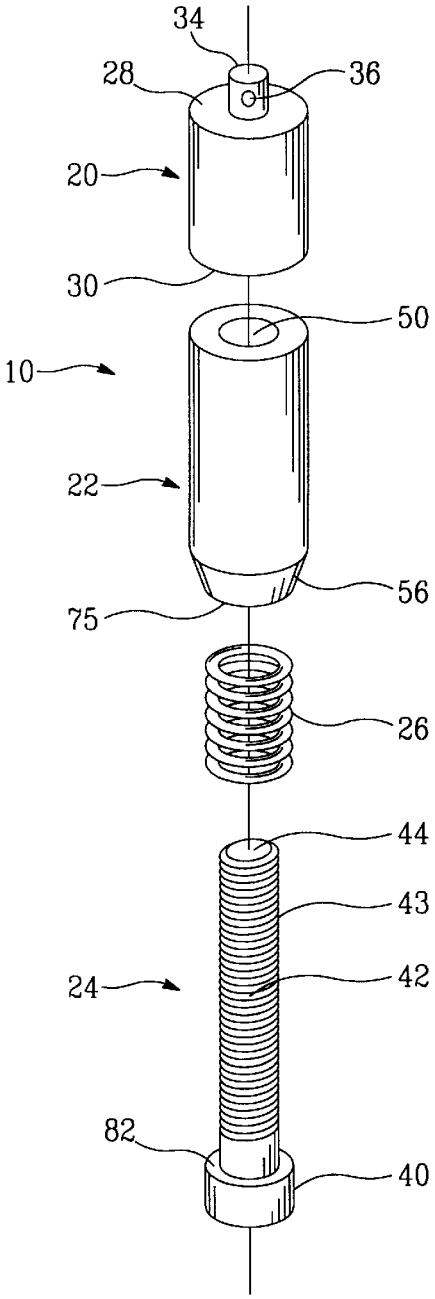
FIG. 1 is a perspective view of the preferred embodiment of the present invention illustrating all components in their uncombined state.

Turning now to the drawing figures, in particular FIGS. 1–6, one embodiment of the cigar punching device 10 of the present invention is illustrated. As can be seen in FIG. 1, the cigar punching device 10 includes a cap 20, a cutting member 22, and a ram 24. Preferably, device 10 will also include a spring 26, which will be described in more detail below.

Figure 2:
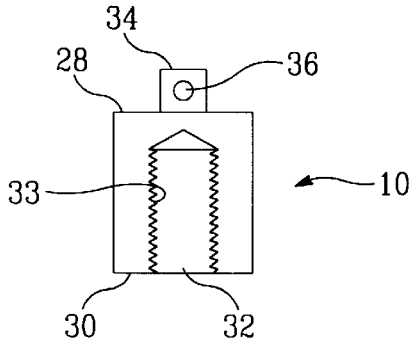
FIG. 2 is a cross sectional view of the cap of the preferred embodiment.

With reference to FIGS. 1 and 2, cap 20 of the cigar punching device 10 includes oppositely disposed ends 28 and 30. End 30 includes an opening 32. Preferably, cap 20 includes a projecting lug 34 at end 28. Projecting lug 34 includes a bore 36, which is adapted to receive a key ring to allow the device to be carried with a set of keys.

Figure 3:
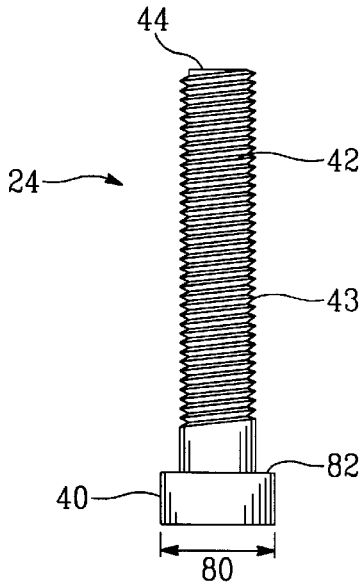
FIG. 3 is a side view of the ram of the preferred embodiment.

Turning now to FIGS. 1 and 3, ram 24 includes a head portion 40 and externally threaded shank portion 42 with threads 43. Distal end 44 of shank portion 42 is adapted to be received within the opening 32 of cap 20, and also passes through cutting member 22, as will be described in more detail below. In the preferred embodiment, distal end 44 is preferably cylindrical in shape, and with a diameter close in dimension to that of opening 32 of cap 20, to facilitate attachment therein. It should be understood, however, that shank portion 42 may also take other suitable shapes which, as long as a sufficient surface area is provided to allow attachment to opening 32. Shank portion 42 is secured within opening 32 of cap 20 by welding, gluing, embedding, pinning, or other permanent attachment means.

Preferably, distal end 44 of shank portion 42 extends substantially all the way in opening 32 of cap 20. However, it should be understood that distal end 44 of shank portion 42 may extend only partially through opening 32 as long as it remains securely and permanently attached. Further, opening 32 may include internal threads 33 which match and retain external threads 43 of distal end 44 of shank portion 42. To aid in permanently affixing the external threads 43 of shank portion 42 to the internal threads 33 of opening 32, a locking element may be applied to the threads.

Figure 4:
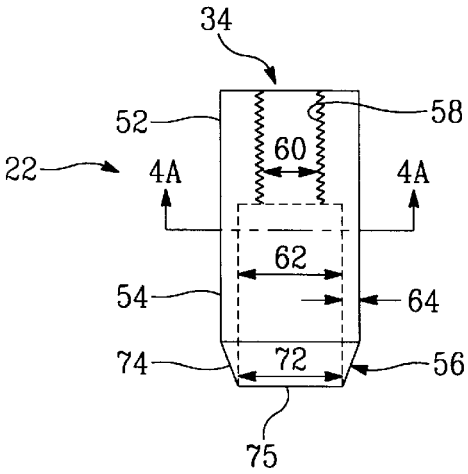
FIG. 4 is a cross sectional view of the cutting member of the preferred embodiment.

With reference now to FIG. 1 and 4, the cutting member 22 includes a central bore 50 through its longitudinal axis and is disposed about ram 24. Cutting member 22 includes an internally threaded proximal end portion 52 with internal threads 58, an intermediate portion 54, and a cutting portion 56. Internal threads 58 of proximal end portion 52 match and mate with the external threads 43 of shank portion 42, thereby permitting cutting member 22 to be screwed about ram 24. This relationship allows the device 10 to be infinitely adjustable as a result of rotation of cutting member 22 about ram 24.

Figure 4A:
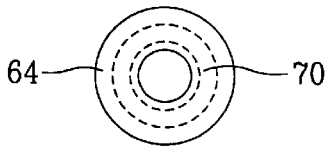
FIG. 4A is a cross sectional view of the cutting member of FIG. 4 taken along lines A—A.
Figure 7:
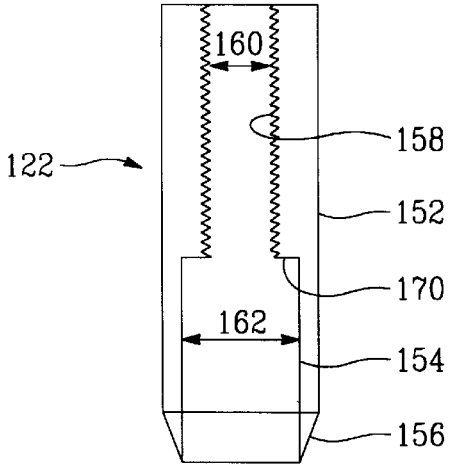
FIG. 7 is a cross sectional view of the cutting member of a first alternative embodiment of the present invention.

Internal diameter 62 of intermediate portion 54 is larger than the internal diameter 60 of proximal end portion 52, thereby forming annular surface area 70 between end portion 52 and intermediate portion 54, as can be seen with reference to FIG. 4A.

Preferably, cap 20 and cutting member 22 are both cylindrical in shape, and have substantially the same diameter. However, it should be understood that cap 20 and cutting member 22 may be any desired shape, including but not limited to rectangular or hexagonal. Cap 20 and cutting member 22 are preferably made from stainless steel, but may be made from any substantially rigid material, which doesn't rust such as anodized aluminum, high impact plastic, or similar materials. Ram 24 is preferably a screw which may be machined down so that the head of the screw has a planar surface. However, it should be understood that ram 24 may be other externally threaded fasteners.

Cutting end portion 56 is preferably angled to form an appropriate cutting edge to adequately punch the tip of the cigar. In the preferred embodiment, cutting end portion 56 is generally tubular except that it tapers at its end. However, it should be understood that cutting end portion 56 may be any shape which effects severing of the tip of a cigar. The inner diameter 72 of cutting end portion 56 is equal to the inner diameter 62 of intermediate portion 54. The outer surface 74 of cutting portion 56 forms a continuous thin cutter with a cutting edge 75, which allows penetration of the cutting portion 56 into the tip of the cigar. In addition, the cutting portion 56 should be of sufficient length to permit a desired portion of the cigar to be removed.

With reference to FIGS. 3, 4, and 4A, the diameter 80 of head portion 40 is substantially equal to the inner diameter 62 of intermediate portion 54 and inner diameter 72 of cutting portion 56, to permit movement of head portion 40 therebetween. Head portion 40 includes an annular inner surface 82 which is substantially equal in surface area to annular surface 70 formed between intermediate portion 54 and end portion 52. Because the diameter of head portion 40 is larger than the internal diameter 62 of proximal end portion 52, head portion 40 is prevented from being removed or detached from the cutting member 22.

Figure 5:
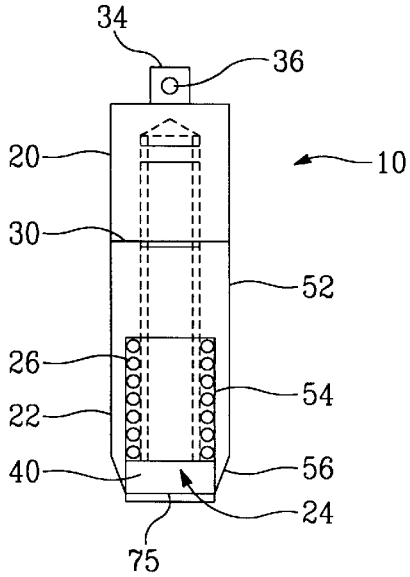
FIG. 5 is a cross sectional view of the preferred embodiment of the present invention illustrating the device in its fully inoperative position.
Figure 6:
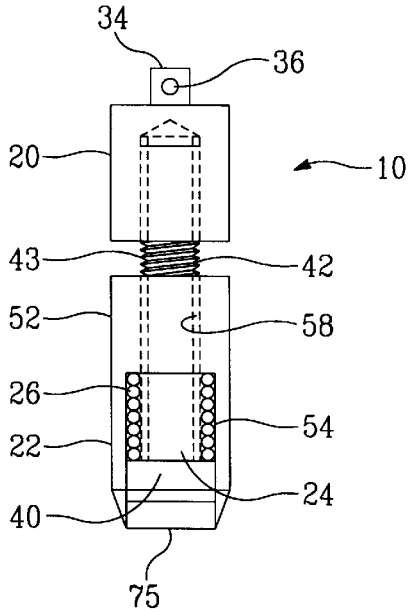
FIG. 6 is a cross sectional view of the preferred embodiment of the present invention illustrating the device in its operative position.

Turning now to FIGS. 1, 5, and 6, the assembly of the punching device 10 will be described in more detail. After cap 20, cutting member 22, and ram 24 have been manufactured, the cigar punching device 10 may be assembled. Spring 26 is preferably placed about shank 42 so that spring 26 rests upon annular Surface 82 of head portion 40. Cutting member 22 is then centered over and placed onto shank 42, thereby compressing spring 26. Shank 42 is first passed through cutting portion 56, then intermediate portion 54, until the external threads 43 of shank portion 42 are engaged by the internal threads 58 of internally threaded end portion 52. Cutting member 22 is screwed onto ram 24 until the spring 26 becomes compressed between the annular surface 82 of head portion 40 and annular surface 70. At this point, distal end 44 of ram 24 extends beyond proximal end portion 52 of cutting member 22, which permits opening 32 of cap 20 to be permanently secured to the ram 24. Spring 26 is preferably made from stainless steel but be made from any material exhibiting similar structural characteristics and which does not rust.

With specific reference to FIGS. 5 and 6, the operation of the cigar punching device 10 will be described in detail. FIG. 5 specifically illustrates cigar punching device 10 in its inoperative first position. In this position, end 30 of cap 20 abuts the proximal end portion 52 of cutting member 22. Likewise, head portion 40 is positioned through cutting portion 56 so that it is substantially flush with and extends just beyond the cutting edge 75. In this way, the cutting edge 75 becomes disabled by the side of the head portion 40, preventing the cutting edge 75 from being exposed. Because the diameter of head portion 40 is substantially equal to the internal diameter of cutting end portion 56, there is minimal space between head portion 140 and cutting portion 56. Thus injury or unintentional cutting by the cutting portion 56 is prevented.

The cigar punching device 10 is moved to a second operative position by twisting cutting member 22 about ram 24 by way of cooperating threads. Thus, device 10 may only be operated by a deliberate twisting force, unlike prior art devices which may be pushed or pulled into operation potentially causing accidental engagement of disengagement. The spring 26 provides extra resistance thereby permitting a precise stop during rotational travel, which makes screwing cutting member 22 more difficult and provides for a better feel. Spring 26 adds to the safety of the device, causing greater resistance to open the device into its second operative position, preventing the cutting member 22 from freely rotating. Unlike prior art devices, a preselected position may be achieved precisely and maintained by the force of the spring. The spring does not act to propel or retract the cutter, as disclosed in prior art devices.

In order to operate device 10, a user may rotate cutting member 22 away from cap 20. This causes head portion 40 to be retracted within the intermediate portion 54 of cutting member 22, thereby exposing cutting end portion 56 at a desired length. The cutting portion 56 may then be used to punch the tip of a cigar. Once the tip of a cigar is severed by the cutting portion 56, the cutting member 22 may be retracted to its first position, as shown in FIG. 5, which causes the head portion 40 to be positioned substantially flush with edge 75, thereby removing the now severed tip of the cigar from cutting port on 56. Thus, this eliminates the need for separate plunging device.

With reference now to FIGS. 7–10, an alternative embodiment of the present invention is illustrated and generally indicated as 110. In this embodiment, cigar punching device 110 includes a single cutting member 122 with an internally threaded proximal end portion 152 having internal threads 158, an intermediate portion 154, and a cutting distal end portion 156. The internal diameter 160 of the proximal end portion 152 is smaller than the internal diameter 162 of intermediate portion 154, thus forming an annular surface area 170 therebetween. The cutting member 122 is substantially similar in structure to and includes features of cutting member 22 of the preferred embodiment. Preferably, cutting member 122 is cylindrical in shape, but may be any other desired shape, including but not limited to rectangular and hexagonal.

Specifically, this embodiment eliminates the need for a cap, thus further minimizing the number of parts required. The diameter 180 of head portion 140 is minimally smaller than diameter 162 of intermediate portion 154 and translates between the cutting end portion 156 and intermediate portion 154, substantially similar to the preferred embodiment described above. The cigar punching device 110 likewise includes a ram 124, with a head portion 140 and an externally threaded shank portion 142 having external threads 143. The ram 124 is also substantially similar in structure to and includes features of ram 24, except that it includes an optional lug 134 at its distal end 144. Lug 134 includes a bore 136 through which a key ring may be received and is substantially similar to the lug 34 of the preferred embodiment. Because the cap is eliminated in this embodiment, the lug 134 should be placed at the end of the ram, in order to permit attachment of cigar punching device 110 to a set of keys. The lug 134 may be produced by being either permanently attached to the distal end 144 of ram 124 by welding, brazing, or any other permanent attachment means, or the threads of ram 124 being turned down to produce a cylinder or similar structure. Alternatively, a bore may be drilled directly into the distal end 144 of shank portion 142, eliminating the necessity for attachment of a separate lug.

In order to assemble the cigar punching device 110, a spring 26 is placed about the shank portion 142 of the ram 124 until the spring 26 abuts the head portion 140. The cutting member 122 is then placed about the ram 124 so that the cutting end portion 156 first passes about the ram 124. The internal threads 158 of proximal end portion 152 engage and mate with the external threads 143 of shank portion 142. The cutting member 122 is screwed onto ram 124 until the lug 134 is projected out of the proximal end portion 152, at which point a key ring may be attached.

Figure 9:
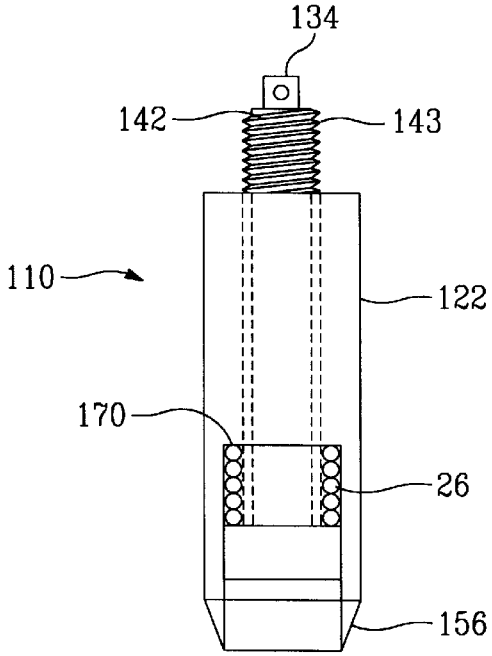
FIG. 9 is a cross sectional view of the first alternative embodiment illustrating the device in its fully operative position.
Figure 8:
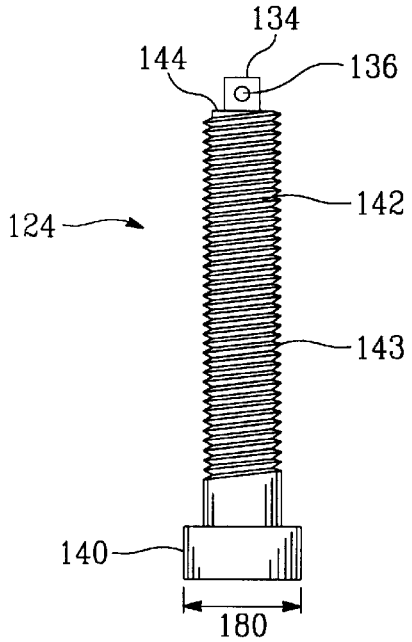
FIG. 8 is a side view of the ram of the first alternative embodiment of the present invention.
Figure 10:
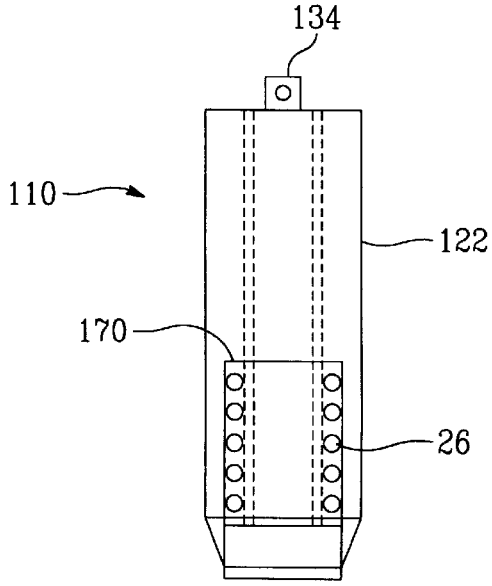
FIG. 10 is a cross sectional view of the first alternative embodiment illustrating the device in its inoperative position.
Figure 11:
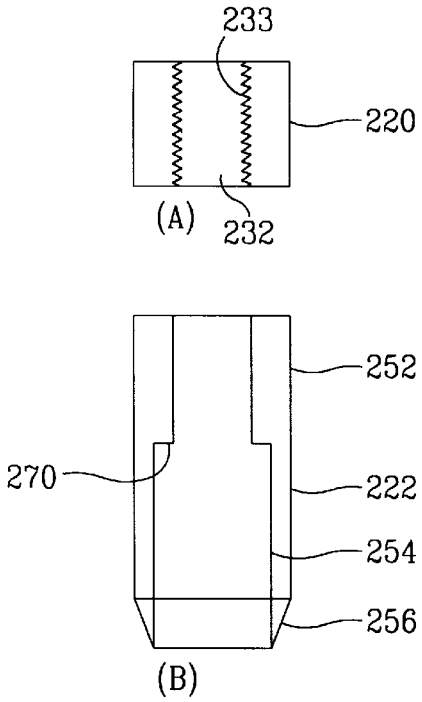
FIG. 11A is a cross sectional view of the first cylindrical member of a second alternative embodiment of the present invention.
FIG. 11B is a cross sectional view of the cutting member of the second alternative embodiment of the present invention.

Referring now specifically to FIGS. 9 and 10, the operation of the cigar punching device 110 will now be described. The cigar punching device 110 operates similar to the cigar punching device 10 of the preferred embodiment, except that device 110 moves from the inoperative position as shown in FIG. 10, to the operative position as shown in FIG. 9 by twisting the exposed distal end 144 of ram 124 through cutting member 122. The key ring attached to lug 134 will prevent the cutting member 122 from being removed from the ram 124.

With reference now to FIGS. 11–14, an additional embodiment of the present invention is illustrated and generally referred to as 210. In this embodiment, device 210 includes a first member 220 and a cutting member 222. The first member 220 is substantially similar in structure to cap 20 except that it includes an internally threaded bore 232 with threads 233 all the way through its center. First member 220 is preferably cylindrical in shape, but may be any other shape, including but not limited to rectangular and hexagonal. Cutting member 222 includes a proximal end portion 252, an intermediate portion 254, and a cutting distal end portion 256. Cutting member 222 is substantially similar in structure to cutting member 22 of the preferred embodiment, and includes features as described above except that proximal end portion 252 is not threaded.

Figure 12:
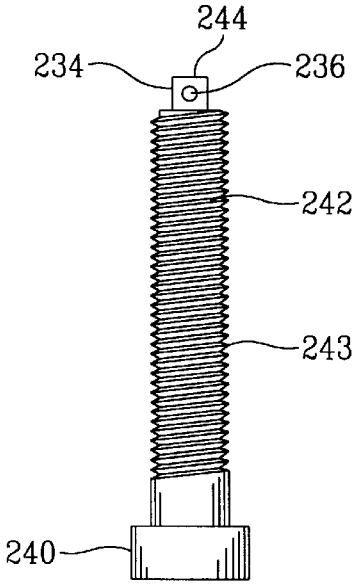
FIG. 12 is a side view of the ram of the second alternative embodiment of the present invention.

With reference now to FIG. 12, the ram 224 disclosed therein is substantially similar to ram 124 and includes features as described above. Ram 224 includes an externally threaded shank portion 242 having threads 243, and a head portion 240. At its distal end 244, a lug 234 with a bore 236 is secured for attaching the device 210 to a key ring. The lug 234 may be produced by being either permanently attached to the distal end 244 of ram 224 by welding, brazing, or any other permanent attachment means, or the threads of ram 224 being turned down to produce a cylinder or similar structure. The lug 234 is produced by permanently attached to the end of ram 224 by welding, brazing, or any other permanent attachment means. Alternatively, a bore may be drilled directly into the distal end 244 of shank portion 242 for attachment to a key ring. In addition, distal end 244 of ram 224 may be turned down to form a lug at its end.

In order to assemble cigar punching device 210, a spring 26 is placed about the shank portion 242 until it abuts head portion 240. The cutting member 222 is placed about ram 224 so that the cutting end portion 256 first passes through the ram 224. The internal threads 233 of threaded member 220 engage and mate with external threads 243 of shank portion 142, whereby the spring 26 becomes depressed. Once lug 234 extends beyond the first member 220, a key ring may be attached. Again, in this embodiment, because there is no cap, the attachment of a key ring will aid in preventing the device 210 from being detached into multiple pieces. However, it should be understood that the attachment of a key ring is not essential, but merely aids in keeping the device as one integral piece. Likewise, other similar structures may be contemplated which function to prevent the device 210 from being detached into multiple pieces.

Figure 13:
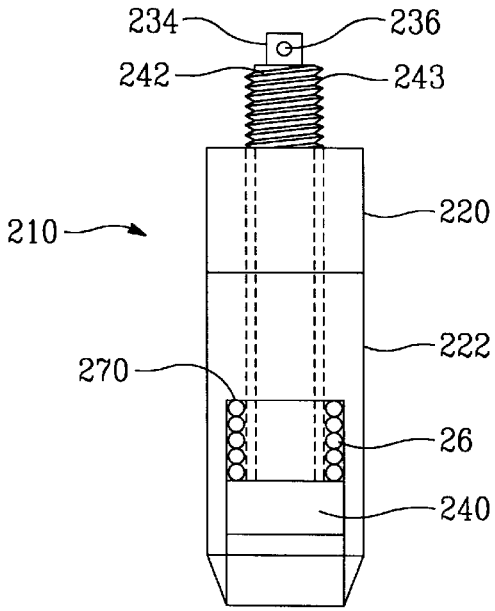
FIG. 13 is a cross sectional view of the second alternative embodiment illustrating the device in its fully operative position.
Figure 14:
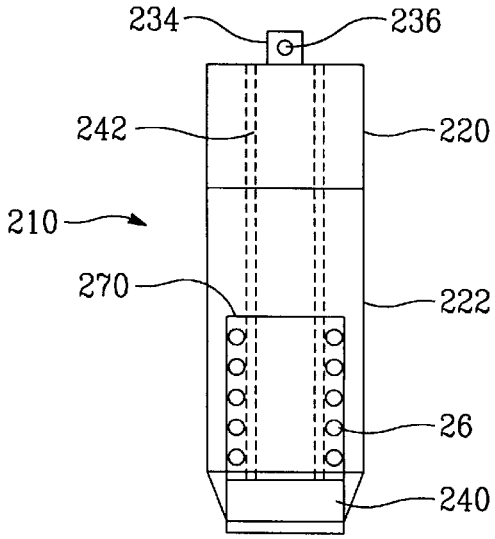
FIG. 14 is a cross sectional view of the second alternative embodiment illustrating the device in its inoperative position.

With reference now to FIGS. 13 and 14, cigar punching device 210 is operated by rotating first member 220 from its inoperative position as shown in FIG. 14, to its operative position as shown in FIG. 13, wherein the cutting portion 256 is extended outwardly away from the distal end 244 of ram 244, and the head portion 240 is retracted within the intermediate portion 254. In its inoperative position, spring 26 is normally uncompressed between the head portion 240 and the proximal end portion 252. In order to operate punching device 210, first member 220 is twisted towards cutting member 222. This forces the cutting member 222 towards head portion 240, thereby compressing the spring between the head portion 240 and the annular surface area 270 formed between the proximal end portion 252 and the intermediate portion 254, until a desired cutting portion 256 is exposed. Because the cutting member 222 is not threaded and does not screw onto the ram 224, the cutting member 222 may alternatively be urged over the head portion 240 without the use of the first member 220. Thus, a tip of a cigar may be severed by simply pulling cutting member 222 away from first member 220, which depresses spring 26 and causes the cutting portion 256 to be exposed. In order to sever a tip of a cigar, the cigar is pressed into the exposed cutting portion 256. After the tip is severed, the cutting member 222 is thereby released which causes cutting member 222 to automatically return to its inoperative position. Thus, the device 210 may always be in its closed position.

While preferred embodiments of the present invention have been illustrated and described, it will be understood that changes and modifications may be made therein without departing from the invention in its broadest aspects.

Having thus described my invention, I claim:

1. A cigar punching device, comprising:

a cap having a first closed end and a second end, said second end having an opening;

a ram having a head portion and an externally threaded shank portion whereby a distal end of said shank portion is secured within said opening of said second end of said cap; and a cutting member having a central bore and disposed about said ram, said cutting member including an internally threaded proximal end portion, an intermediate portion, and a tubular cutting distal end portion, said internal threads of said cutting member matching and mating with said external threads of said ram so that said cutting member may be screwed about said ram between a first position wherein said proximal end of said cutting member abuts said second end of said cap and said head portion of said ram is penetrated through said cutting end portion, to a second position wherein said proximal end of said cutting member is spaced from said second end of said cap, said head portion is retracted within said cutting member, and said cutting end portion is exposed and operative to receive and thereby sever a tip of a cigar.

2. The cigar punching device of claim 1, further comprising a spring disposed about said ram between said internally threaded proximal end portion of said cutting member and said head portion of said ram for causing resistance therebetween.

3. The cigar punching device of claim 1, wherein said cap and said cutting member are cylindrical in shape and have the same outer diameter so that said cutting member and said cap form a continuous cylindrical body when in said first position.

4. The cigar punching device of claim 3, wherein said cap and said cutting member are made of a material from the group consisting of stainless steel, anodized aluminum, and high impact plastic.

5. The cigar punching device of claim 1, wherein said cutting end portion of said cutting member is chamfered.

6. The cigar punching device of claim 5, wherein said angle of said cutting end portion is preferably less than 45 degrees measured from an outer circumference of said intermediate portion of said cutting member.

7. The cigar punching device of claim 1, wherein said distal end of said shank portion is permanently secured within said second end of said cap.

8. The cigar punching device of claim 1, wherein said opening of said second end of said cap is internally threaded to mate with and retain said externally threaded distal end portion of said ram.

9. The cigar punching device of claim 1, further comprising a lug projecting from said first end of said cap, said lug having a bore for receiving a key ring.

10. A cigar punching device, comprising:

a ram having a head portion and an externally threaded shank portion; and a cutting member having a central bore and disposed about said ram, said cutting member including an internally threaded proximal end portion, an intermediate portion, and a tubular cutting distal end portion, said internal threads of said cutting member matching and mating with said external threads of said ram so that said cutting member may be screwed about said ram between a first position wherein said head portion of said ram is penetrated through said cutting end portion and a second position wherein said head portion is retracted within said cutting member and said cutting end portion is exposed and operative to receive and thereby sever a tip of a cigar.

11. The cigar punching device of claim 10, further comprising a spring disposed about said ram between said internally threaded proximal end portion of said cutting member and said head portion of said ram for causing resistance therebetween.

12. The cigar punching device of claim 10, wherein said cutting end portion of said cutting member is chamfered.

13. The cigar punching device of claim 12, wherein said angle of said cutting end portion is preferably less than 45 degrees measured from an outer circumference of said intermediate portion of said cutting member.

14. The cigar punching device of claim 10, wherein said cutting member is made of a material from the group consisting of stainless steel, anodized aluminum, and high impact plastic.

15. The cigar punching device of claim 10, wherein a distal end of said shank portion includes a bore for receiving a key ring.

16. A cigar punching device, comprising:

a first member having an internally threaded central bore;

a ram having a head portion and an externally threaded shank portion, said external threads of said shank portion matching and mating with said internal threads of said first member;

a cutting member having a central bore and disposed about said ram, said cutting member including a proximal end portion, an intermediate portion, and a tubular cutting distal end portion wherein an internal diameter of said intermediate portion is greater than an internal diameter of said proximal end portion thereby forming an internal annular surface therebetween, a spring disposed about said ram in said intermediate portion of said cutting member between said internal annular surface of said cutting member and said head portion of said ram whereby screwing said first member towards said cutting member causes said spring to be compressed between said head portion and said internal annular portion, said head portion to be retracted within said cutting member, and said cutting end portion to be exposed and operative to receive and thereby sever a tip of a cigar.

17. The cigar punching device of claim 16, wherein a distal end of said shank portion includes a bore for receiving a key ring.

18. The cigar punching device of claim 16, wherein said first member and said cutting member are cylindrical in shape and have the same outer diameter so that said first member and said cutting member form a continuous cylindrical body.

19. The cigar punching device of claim 16, wherein said first member and said cutting member are made of a material from the group consisting of stainless steel, anodized aluminum, and high impact plastic.

20. The device of claim 16, wherein said cutting end portion of said cutting member is chamfered.

21. The device of claim 20, wherein said angle of said cutting end portion is less than 45 degrees measured from an outer circumference of said intermediate portion of said cutting member.

22. The cigar punching device of claim 1, wherein said head portion of the ram is adapted to temporarily disable said cutting end portion when penetrated through said cutting end portion.

23. The cigar punching device of claim 1, wherein said head portion bears against said cutting end portion when said head portion is penetrated through said cutting end portion, so that said head portion prevents said cutting end portion from cutting as long as said head portion remains penetrated through said cutting end portion.

24. The cigar punching device of claim 10, wherein said head portion of the ram is adapted to temporarily disable said cutting end portion when penetrated through said cutting end portion.

25. The cigar punching device of claim 10, wherein said head portion bears against said cutting end portion when said head portion is penetrated through said cutting end portion, so that said head portion prevents said cutting end portion from cutting as long as said head portion remains penetrated through said cutting end portion.

26. The cigar punching device of claim 16, wherein said head portion of the ram is adapted to temporarily disable said cutting end portion when penetrated through said cutting end portion.

27. The cigar punching device of claim 16, wherein said head portion bears against said cutting end portion when said head portion is penetrated through said cutting end portion, so that said head portion prevents said cutting end portion from cutting as long as said head portion remains penetrated through said cutting end portion.

28. A cigar punching device comprising:

a cap having a first closed end and a second end, said second end having an opening;

a ram having a head portion and a shank portion, said shank portion having a distal end secured within said opening of said second end of said cap; and a cutting member having a central bore and disposed about said ram, said cutting member including a proximal end portion, an intermediate portion, and a tubular cutting distal end portion, said cutting member being movable with respect to said ram between a first position wherein said proximal end of said cutting member abuts said second end of said cap and said head portion of said ram is penetrated through said cutting end portion, and a second position wherein said proximal end of said cutting member is spaced from said second end of said cap, said head portion is retracted within said cutting member, and said cutting end portion is exposed and operative to receive and thereby sever a tip of a cigar, wherein said cutting end portion is disabled by said ram when said cutting member is in said first position.

29. The cigar punch device of claim 28, wherein said cutting member and ram are arranged with respect to one another so that, in said first position, said head portion bears against said cutting end portion to prevent said cutting end portion from cutting.

* * * * *